US007694442B2

(12) United States Patent
Stanek et al.

(10) Patent No.: US 7,694,442 B2
(45) Date of Patent: Apr. 13, 2010

(54) RECOMMENDING A MACHINE REPOSITIONING DISTANCE IN AN EXCAVATING OPERATION

(75) Inventors: Daniel Stanek, Chillicothe, IL (US); Roger D. Koch, Pekin, IL (US); Jeffrey S. Alig, Metamora, IL (US); Robert J. Price, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 486 days.

(21) Appl. No.: 11/606,037

(22) Filed: Nov. 30, 2006

(65) Prior Publication Data

US 2008/0127529 A1 Jun. 5, 2008

(51) Int. Cl.
*E02F 5/00* (2006.01)

(52) U.S. Cl. ..... 37/348

(58) Field of Classification Search ..... 37/348, 37/444, 382, 414; 172/2–11; 701/50; 414/699, 414/700

See application file for complete search history.

(56) References Cited

U.S. PATENT DOCUMENTS 3,339,763 A 9/1967 Caywood et al.
4,015,729 A 4/1977 Parquet et al.
4,140,144 A 2/1979 Dowd et al.
4,288,196 A 9/1981 Sutton, II
4,531,883 A 7/1985 Arnold
4,677,555 A 6/1987 Goyet
4,869,337 A 9/1989 Wagner
5,065,326 A 11/1991 Sahm
5,138,756 A 8/1992 Johnson et al.
5,347,448 A 9/1994 Nam
5,404,661 A * 4/1995 Sahm et al. ..... 37/348
5,528,843 A 6/1996 Rocke
5,546,093 A 8/1996 Gudat et al.
5,699,247 A 12/1997 Moriya et al.
5,806,016 A 9/1998 Henderson et al.
5,854,988 A 12/1998 Davidson et al.
6,062,317 A 5/2000 Gharsalli et al.
6,076,030 A 6/2000 Rowe
6,108,949 A 8/2000 Singh et al.
6,131,062 A 10/2000 Nielsen
6,167,336 A 12/2000 Singh et al.
6,223,110 B1 4/2001 Rowe et al.
6,234,254 B1 5/2001 Dietz et al.
6,247,538 B1 6/2001 Takeda et al.
6,292,729 B2 9/2001 Falck et al.
6,354,023 B1 3/2002 Trahan et al.
6,363,632 B1 4/2002 Stentz et al.
6,371,214 B1 4/2002 Anwar et al.
6,418,364 B1 7/2002 Kalafut et al.

(Continued)

FOREIGN PATENT DOCUMENTS

EP 1 288 377 3/2003

(Continued)

*Primary Examiner*—Robert E Pezzuto
(74) *Attorney, Agent, or Firm*—Finnegan, Henderson, Farabow, Garrett & Dunner

(57) ABSTRACT

A system and method of assisting an operator of an excavating machine includes recommending a hop distance to move the machine based on the maximum distance that the machine can move and still be able to reach the bottom of the excavation that has already been dug by the machine during an excavating operation.

20 Claims, 8 Drawing Sheets

U.S. PATENT DOCUMENTS

| | | | | |
|---|---|---|---|---|
| 6,430,850 | B1 | 8/2002 | VanDerZyl et al. | |
| 6,510,628 | B1 | 1/2003 | Koch | |
| 6,542,789 | B2 | 4/2003 | Ufheil | |
| 6,604,305 | B2 | 8/2003 | Koch | |
| 6,609,315 | B1 | 8/2003 | Hendron et al. | |
| 6,643,577 | B1 | 11/2003 | Padgett et al. | |
| 6,658,767 | B2 | 12/2003 | Kelly et al. | |
| 6,691,010 | B1 | 2/2004 | Gay | |
| 6,701,239 | B2 | 3/2004 | Keefer | |
| 6,718,244 | B2 | 4/2004 | Lin et al. | |
| 6,725,142 | B2 | 4/2004 | Koch | |
| 6,732,458 | B2 | 5/2004 | Kurenuma et al. | |
| 6,736,216 | B2 | 5/2004 | Savard et al. | |
| 6,757,994 | B1 | 7/2004 | Hendron | |
| 6,763,619 | B2 | 7/2004 | Hendron et al. | |
| 6,766,600 | B2 * | 7/2004 | Ogura et al. | 37/348 |
| 6,819,993 | B2 | 11/2004 | Koch | |
| 6,851,495 | B2 | 2/2005 | Sprinkle et al. | |
| 6,879,899 | B2 | 4/2005 | Budde | |
| 6,907,336 | B2 | 6/2005 | Gray et al. | |
| 6,915,599 | B2 | 7/2005 | Lohnes et al. | |
| 6,934,615 | B2 | 8/2005 | Flann et al. | |
| 6,954,999 | B1 | 10/2005 | Richardson et al. | |
| 6,980,895 | B2 | 12/2005 | Paice et al. | |
| 7,007,415 | B2 | 3/2006 | Koch | |
| 7,010,367 | B2 | 3/2006 | Koch et al. | |
| 7,010,425 | B2 | 3/2006 | Gray et al. | |
| 7,032,703 | B2 | 4/2006 | Wulfert et al. | |
| 2005/0209759 | A1 | 9/2005 | Lee | |
| 2006/0034535 | A1 | 2/2006 | Koch et al. | |
| 2006/0064221 | A1 | 3/2006 | Sporer et al. | |
| 2006/0089773 | A1 | 4/2006 | Hendron et al. | |
| 2006/0090379 | A1 | 5/2006 | Furem | |
| 2006/0095186 | A1 | 5/2006 | Hendron et al. | |
| 2006/0137931 | A1 | 6/2006 | Berg et al. | |
| 2006/0225310 | A1 | 10/2006 | Koch | |

FOREIGN PATENT DOCUMENTS

| | | |
|---|---|---|
| EP | 1 650 359 | 4/2006 |
| GB | 2 392 147 | 2/2004 |
| GB | 2 412 362 | 9/2005 |
| WO | WO 98/44205 | 10/1998 |

* cited by examiner

RECOMMENDING A MACHINE REPOSITIONING DISTANCE IN AN EXCAVATING OPERATION

TECHNICAL FIELD

This disclosure relates to recommending a machine repositioning distance in an excavating operation and, more particularly, to a method and a system for automated calculation and recommendation of an efficient, permissible distance for machine repositioning during an excavating operation.

BACKGROUND

Many machines have been developed for excavating. One commercially available type of machine often used for excavating, for example in a trenching operation, is a backhoe. Generally, a backhoe is mounted on a tractor or other machine body moveable along the ground on wheels or tracks. The backhoe may be the only excavating assemblage or handling implement on the tractor or machine body, or it may be one of a plurality of implements. For example, one relatively common machine, generally known as a backhoe loader, may include a backhoe mounted at one end of a tractor, and may include a loader bucket and accompanying operating linkage mounted at the other end of the tractor.

A typical backhoe may include a boom, a stick, and a bucket. In general, the boom may be pivoted to the machine for movement in a generally vertical plane, the stick may be pivotally mounted to the boom for movement in the same generally vertical plane, and the bucket may be pivotally mounted to the stick. The stick may be a fixed length element or it may be of the extendable, e-stick type. Each of the boom, stick, and bucket may be moved about a pivotal connection by one or more actuators, such as hydraulic cylinders. The entire excavating assemblage of boom, stick, and bucket may be mounted on the machine body for swinging movement in a generally horizontal plane relative to the machine body.

Another relatively common machine that employs a backhoe-type implement is generally known as a hydraulic excavator. A hydraulic excavator may have a number of features in common with the backhoe of a backhoe loader. For example, a hydraulic excavator may include a boom, a stick, and a bucket as the excavating assemblage. However, in a hydraulic excavator, the excavating assemblage does not swing in a horizontal plane relative to the machine body as does the excavating assemblage in a backhoe loader. Rather, in a hydraulic excavator, the entire upper machine body rotates relative to an undercarriage. Thus, the position of the excavating assemblage on a worksite in a relatively horizontal plane is altered by rotating the entire upper machine body.

In excavating a trench, for example, the operator of a machine, such as a backhoe, manipulates the machine controls to cause the boom, stick, and bucket to move in coordination such that the bucket digs into the earth generally along the direction of extent of the proposed trench. The bucket is moved about its pivot to become filled with earth, the filled bucket is held in a curled position relative to the stick, and lifted by coordinated movement of the boom and stick from the trench being formed. The excavating assemblage of boom, stick, and bucket is then swung away from the trench for dumping, either into a pile adjacent the trench, or into a waiting container or carrier, such as a dump truck.

A proposed excavation may be larger in extent than the reach from a single set-up location of the machine that is selected to create the excavation. For example, where a backhoe loader is selected to excavate a trench of some defined length, the backhoe loader may only be capable of excavating a portion of the trench from a single set-up position of the backhoe loader. In order to complete the assigned trench, after trenching to the extent of the reach of the backhoe, it becomes necessary to move the machine to a new set-up position so that excavating can continue and the trench can be completed. Often, it may be necessary to repeat this process several times where the proposed trench has a length several times the working extent of the machine performing the excavating operation.

The movement of a machine during a trenching operation, from one set-up position to another, may be referred to in a number of ways. For example, the movement may be referred to as a "hop," or it may be referred to simply as a repositioning. Regardless of the name assigned to this movement to new set-up positions between excavating phases, the movement entails a number of particular acts and requires a significant measure of skill by the machine operator. For example, where the machine of choice for a trenching operation is a backhoe loader, the operator may be required to separately manipulate controls to alter engine speed, lift the loader bucket from ground engagement, retract machine stabilizers, alter engine speed again for engagement of a transmission gear, move the tractor or machine a proper distance for set-up, etc.

Since the excavating assemblage of a backhoe loader is mounted at the rear of the tractor, the operator is facing to the rear during an excavating phase, with the front of the tractor facing generally in the direction of the proposed (but not yet excavated) trench. For movement to a new set-up position, the operator must at some point reposition himself to face toward the front of the tractor, usually by swiveling the operator seat from a rear facing orientation to a front facing orientation. Controls for the backhoe, and perhaps the stabilizers, may be located convenient to the rear-facing direction, while controls for the loader bucket, steering, engine throttle, and brake may be located convenient to the front-facing direction.

Time may be lost in the individual performance by the operator of the several steps involved in machine movement. Swiveling between the rear facing and front facing positions to individually manipulate the several controls involved in movement to a new set-up position may be yet one more factor contributing to operator fatigue. Relying on the operator to determine the appropriate movement distance may not yield the most efficient repositioning of the tractor. It is desirable to maximize productivity by, for example, minimizing the number of machine repositionings, or hops, during an excavating operation by, for example, minimizing the repositioning or hop distance between excavating phases. Some efficient and effective manner of addressing these issues would be both beneficial and desirable.

U.S. Pat. No. 6,418,364 to Kalafut et al. relates to determining a position and heading of a work machine. The Kalafut et al. patent discloses that a machine, such as a backhoe loader, may be subject to shifting about from its initial position and heading during digging. Recognizing that a backhoe loader must frequently be moved as a trench is created, the Kalafut et al. patent discloses that, to compensate for such shifting, an external reference point is utilized to periodically assist in determining a new position and heading for the work machine. In this way, the machine apparently may be maintained on the planned trenching path.

While the arrangement in the Kalafut et al. patent may be useful for making machine corrections as a trenching operation progresses, the Kalafut et al. patent does not recognize the efficiency concerns associated with repositioning of the machine between excavating phases. Kalafut et al. does not disclose calculation and recommendation of an efficient permissible distance for machine movement during a repositioning phase between excavating phases. Thus, the system of the Kalafut et al. patent may not yield efficient repositioning of the machine between excavating phases in a multiple-phase excavating operation.

The disclosed embodiments are directed toward improvements and advancements over the foregoing technology.

SUMMARY OF THE INVENTION

In one aspect, the present disclosure is directed to a method of assisting an operator of an excavating machine. The method includes recommending a hop distance to move the machine based upon the maximum distance the machine can move and still be able to reach the bottom of the excavation that has already been dug by the machine during an excavating operation.

In another aspect, the present disclosure is directed to a system for efficiently excavating a trench requiring a plurality of excavating phases, each from a different machine set-up position. The system includes an excavating assemblage and a plurality of machine elements configured to facilitate machine set-up during an excavating operation. The system further includes a control system configured to calculate an efficient permissible distance for machine movement between excavating phases and configured to recommend the efficient permissible distance to an operator.

DETAILED DESCRIPTION

Figure 1:
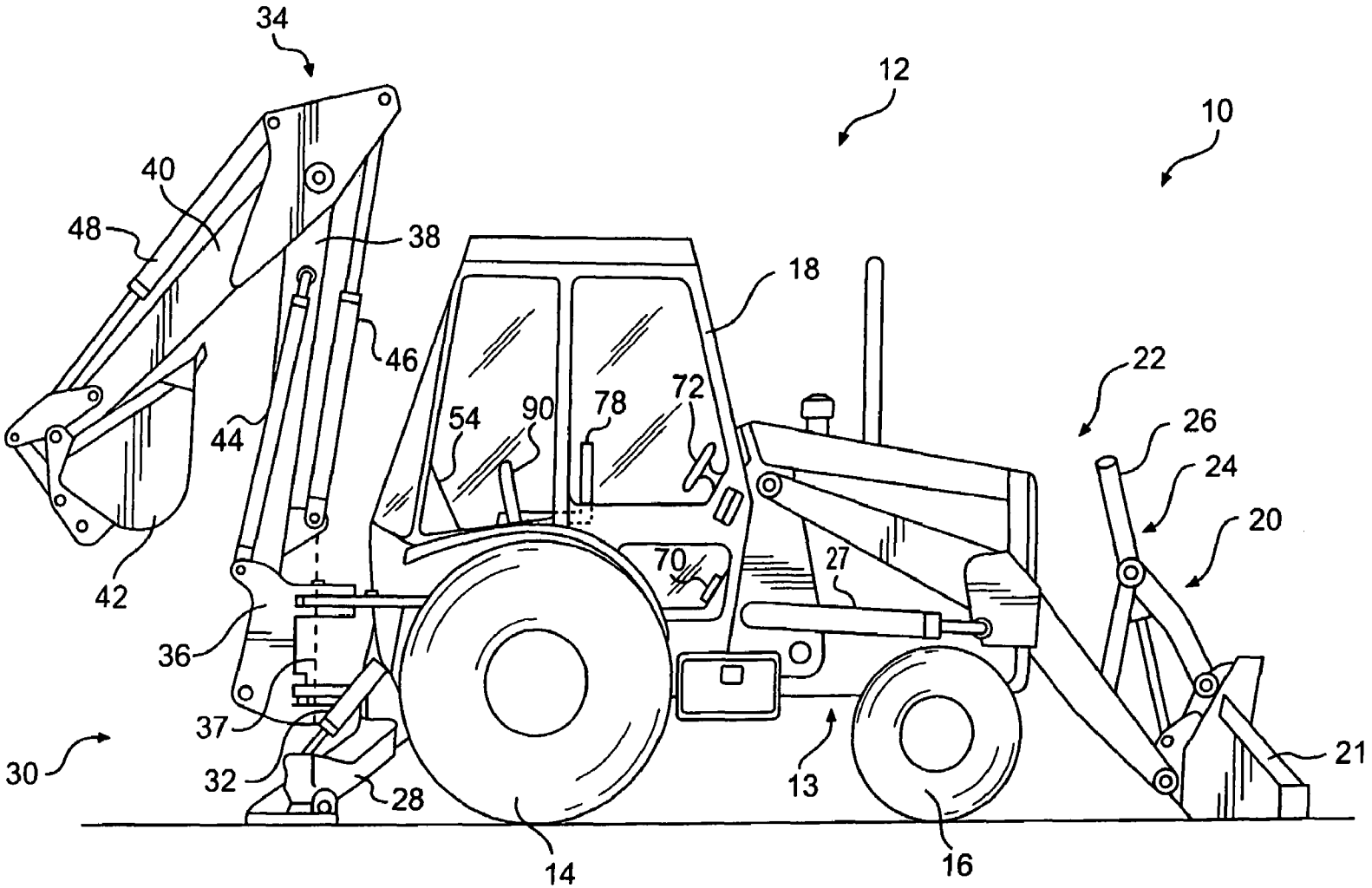
FIG. 1 is a generalized representation of a backhoe loader according to an exemplary disclosed embodiment.

FIG. 1 illustrates an exemplary backhoe loader 10 that may be employed in connection with embodiments of the disclosure. Backhoe loader 10 may include a machine, such as a tractor 12. Tractor 12 may include a chassis 13 and a ground transportation assembly, including a pair of rear wheels 14 and a pair of front wheels 16 mounted to chassis 13. It should be understood that, instead of wheels 14 and 16, the tractor 12 could be provided with a pair of tracks or other structure to permit ground transportation. Backhoe loader 10 also may include a cab 18 or other suitable facilities to accommodate an operator and to house machine controls.

The backhoe loader 10 may include a front loader assembly 20 including a loader bucket 21 at a front end 22 of the tractor 12, and suitable operating linkage 24 for manipulation of the loader bucket.21 under the control of actuators 26 and 27, such as hydraulic cylinders. The backhoe loader 10 may include a pair of stabilizers, one of which is shown at 28 in FIG. 1. While one stabilizer is illustrated in FIG. 1, it will be understood that a similar stabilizer may be similarly mounted at the opposite side of the tractor 12 as can readily be seen by reference to FIG. 3. Both stabilizers 28 are mounted adjacent a rear end 30 of tractor 12. The stabilizers 28 may be hydraulically controlled (for example via hydraulic cylinder 32) in a relatively conventional manner to swing between a retracted, stored position out of ground contact, and an extended, deployed position in which they contact the ground.

The backhoe loader 10 may also include an excavating assemblage 34, for example, a backhoe mechanism, at the rear end 30 of the tractor 12. The excavating assemblage 34 may include a suitable swing assembly 36 for permitting the backhoe mechanism to swing about an axis designated 37 from one side of the tractor 12 to the other. The swing assembly 36 may move under the control of one or more hydraulic cylinders (not shown) about the axis 37, and may serve to move the excavating assemblage 34 from an excavating position to a dumping position, for example.

The excavating assemblage 34 may include a boom 38 having a first end pivotally mounted adjacent the tractor 12 for movement in a generally vertical plane. A stick 40 may have a first end pivotally mounted adjacent the second end of the boom 38 for movement in the same generally vertical plane in which the boom 38 may move. An excavating implement, for example, in the form of a bucket 42, may be pivotally mounted at a second end of the stick 40 for pivotal movement in the same generally vertical plane in which the boom 38 and stick 40 may move. The boom 38 may be pivotally moved under the control of a hydraulic cylinder 44. The stick 40 may be pivotally moved under the control of a hydraulic cylinder 46. The bucket 42 may be pivotally moved under the control of a hydraulic cylinder 48.

Figure 2:
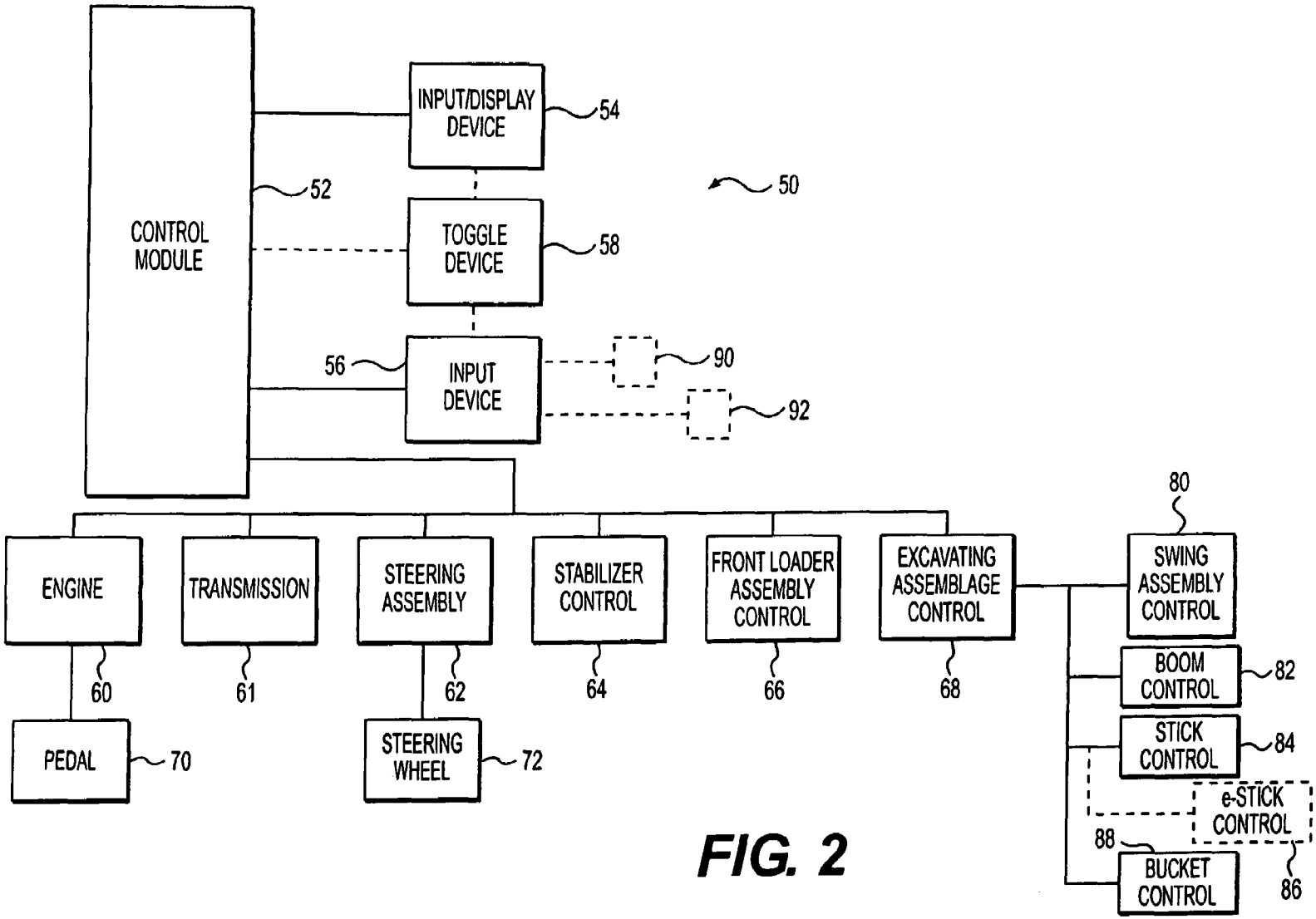
FIG. 2 diagrammatically illustrates an exemplary embodiment of a control system.

FIG. 2 illustrates one exemplary control system 50 that may be employed in connection with disclosed embodiments. Control system 50 may include a suitable control module 52 (e.g., an electronic control module, or ECM) which, in turn, may include a suitable programmable memory and a processor. Control module 52 maybe located in cab 18 of tractor 12. An input/display device 54 may be suitably associated with the control module 52 and configured to permit an operator to input data. For example, input/display device 54 may be a touch screen display device, or touch-sensitive display screen, generally known, but suitably configured for purposes to be described herein.

Input/display device 54 may be positioned at a suitable location such that an operator may readily view it and access it, but will be unlikely, via input/display device 54, to inadvertently activate a particular mechanism or control a particular function. In other words, input/display device 54 is so located as to increase the probability that activation of input functions will occur only upon purposeful intervention by the operator rather than by inadvertence. Such a touch screen may be suitably configured to permit input and display of a wide array of information associated with control and operation of backhoe loader 10. Additionally, suitable flags may appear on the touch screen to convey safety information to the operator. For example only, a suitable flag may indicate whether the machine brakes are locked.

An input device 56 and a toggle device 58 also may be associated with control module 52. Input device 56 may be one or more joysticks, keyboards, levers, or other input devices known in the art. For example, input device 56 may include left joystick 90 (seen also in FIG. 1) and right joystick 92. Toggle device 58 may be employed to alter the mode of input device 56, which may include altering the mode of one or both of joysticks 90, 92. Thus, in one mode, input device 56 may be a joystick configured to control manipulation of the various articulated elements of excavating assemblage 34. In another mode, the same joystick may be configured to control steering and propulsion of tractor 12. Toggle device 58 may be, for example, a switch, button, lever, etc., which may be suitably mounted on a control panel within cab 18. In one embodiment, toggle device 58 may be mounted on a joystick, where input device 56 is a joystick. In another exemplary embodiment, toggle device 58 may be a virtual button that an operator may access and activate on a touch screen display constituting the input/display device 54. The virtual button may be an icon, a picture, an image, or any other computer generated representation that may appear on a touch screen display and be subject to activation by an operator.

In another exemplary embodiment, input device 56 may include at least two joysticks, such as joysticks 90, 92, that may be employed in connection with operation of the front loader assembly 20. For example, with the operator seat 78 positioned facing in a forward direction, an operator may control movement and steering of the tractor 12 with one joystick, such as the one positioned to the left of the operator, and an operator may control the manipulation of the front loader assembly with the other joystick, such as the one positioned to the right of the operator. Alternatively, the control functions of the two joysticks could be reversed, with the left joystick controlling the front loader assembly manipulation and the right joystick controlling tractor movement and steering.

Control module 52 may be suitably configured to receive signals from and send signals to all the various subassemblies and elements of the backhoe loader 10. For example, referring to the exemplary and diagrammatically illustrated control system of FIG. 2, control module 52 may send signals to and receive signals from engine 60 to control engine speed, transmission 61 to control shifting of gears, steering assembly 62 to control machine steering, stabilizer control 64, front loader assembly control 66, and excavating assemblage control 68. Excavating assemblage control 68 may include swing assembly control 80, boom control 82, stick control 84, optional e-stick control 86, and bucket control 88. As is generally known, engine speed may be manually regulated by an operator via, for example, a pedal 70. Similarly, steering may be manually regulated by an operator via, for example, a steering wheel 72.

Figure 3:
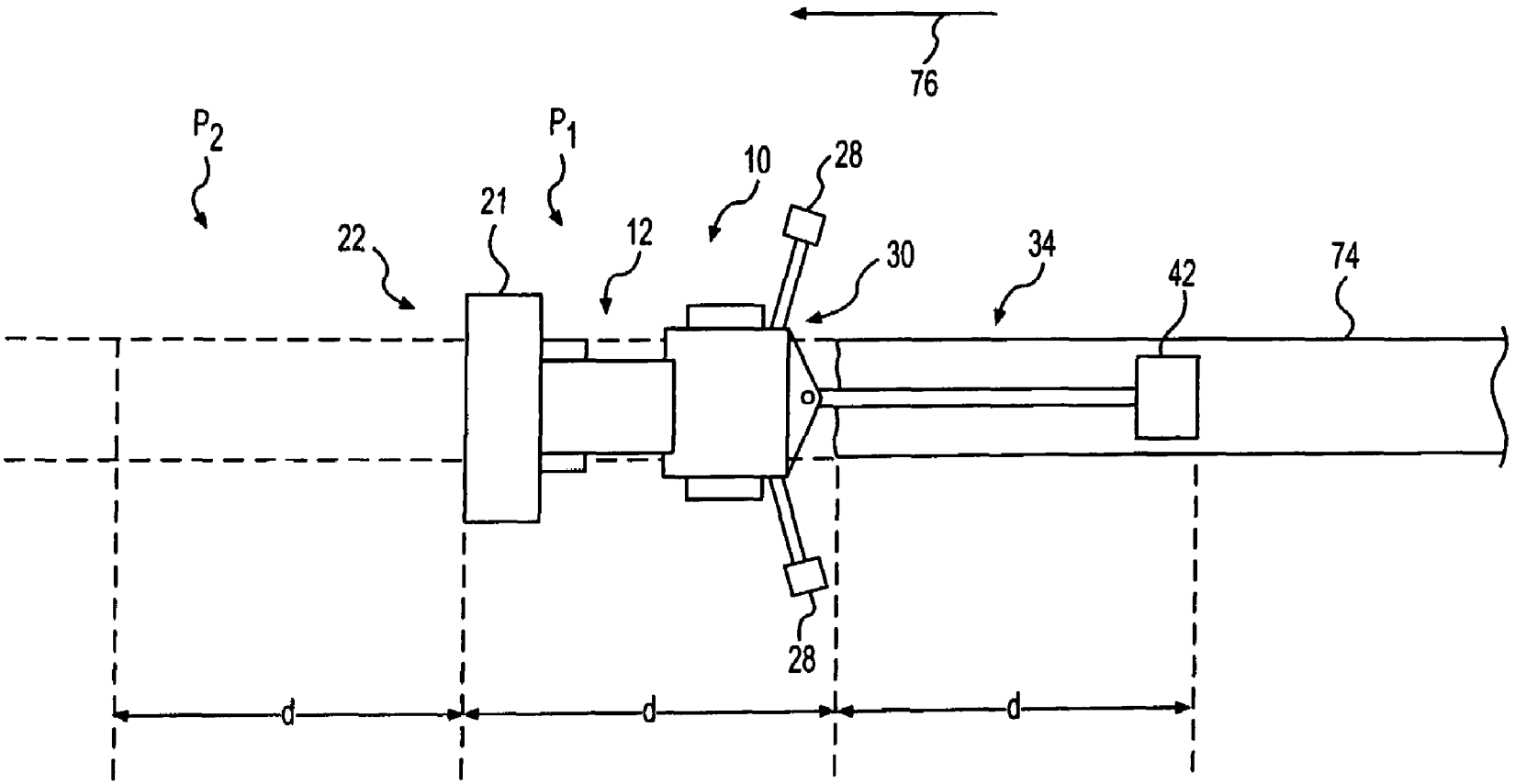
FIG. 3 is a schematic view of a backhoe loader in the process of excavating an elongated trench according to an exemplary disclosed embodiment.
Figure 4:
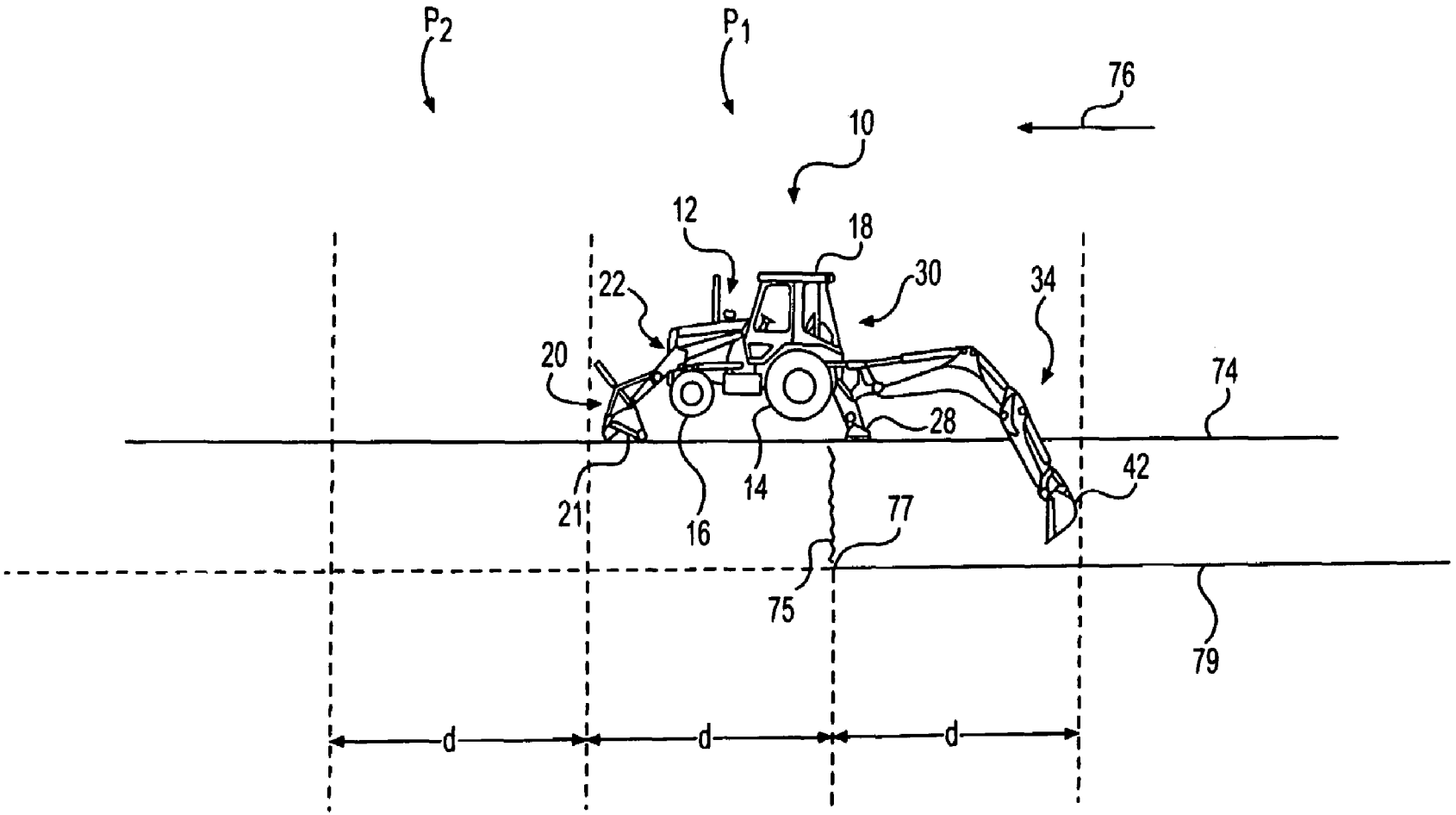
FIG. 4 is a side view of a trenching operation according to an exemplary disclosed embodiment.

FIG. 3 is a diagrammatic illustration of a tractor 12, for example the tractor of a backhoe loader 10, set up in position $P_1$ for excavating an elongated trench 74. Tractor 12 may be anchored in position by the outstretched stabilizers 28, aided by the loader bucket 21. In other words, the two outstretched stabilizers 28, along with the loader bucket 21, pressed firmly against the ground by the operating linkage 24 and actuators 26 and 27 (see FIG. 1), may hold the tractor 12 in a stationary position while the excavating assemblage 34 performs trenching operations within the range of movement of the pivotally mounted boom 38, stick 40, and bucket 42 (FIG. 1) of the excavating assemblage 34. FIG. 4 diagrammatically illustrates tractor 12 in side view supported by stabilizers 28 and loader bucket 21. The trench 74 is diagrammatically shown in FIGS. 3 and 4 as being of greater continuous extent than the working reach of the excavating assemblage 34, as is usually the case in actual practice, with the excavated portion in solid lines and the proposed, but as yet unexcavated portion in dotted lines. The direction in which digging along the trench proceeds is represented in FIGS. 3 and 4 by the arrow 76.

In FIGS. 3 and 4, the distance d designates the working reach of the excavating assemblage 34 at a single set-up position of the tractor 12. This working reach d represents the distance along the trench 74 that the excavating assemblage 34 can dig and still maintain the design depth of the trench and keep the bottom, or floor, of the trench reasonably smooth and free of substantial irregularities. Of course, the working reach d of a particular machine may vary, depending on a number of site specific factors. In particular, as the design depth of the trench increases, the working reach d will decrease. Another factor which may have some effect on the working reach d may be the type of material (rocky soil, wet clay, sandy soil, for example) being excavated. Additionally, the shape and size of the particular bucket 42 employed in a trenching operation may affect the working reach d. Suffice it to say that the working reach d may vary with site conditions, but it is determinative of when tractor 12 is to be repositioned from a current set-up position, such as $P_1$ to a new set-up position, such as $P_2$.

After excavating the trench 74 to the design depth, and as close to the tractor 12 as is practical, the tractor 12 must be repositioned before excavating may continue. Thus, referring to FIGS. 3 and 4, tractor 12 may be repositioned to position $P_2$ by moving tractor 12 in the direction of arrow 76 by the distance d. The excavating assemblage 34 at the rear portion 30 of tractor 12 will then be in a position for a new excavating phase to excavate a new section of trench 74 within a working reach d located in the area where tractor 12 had been set-up at position $P_1$ for the previous excavating phase. This distance d (designated d since it is equivalent to the working reach) may be referred to as the "hop distance" or the "repositioning distance," for example. Where the term "hop distance" or "repositioning distance" is used in this description, it will be understood to refer to the distance an excavating machine, such as a hydraulic excavator or a backhoe loader, is moved between excavating phases in order to continue an excavation, such as a trench. Thus, referring to FIGS. 3 and 4, for example, the distance d for machine movement from position $P_1$ to position $P_2$ would be a hop distance or repositioning distance, as well as the working reach.

Ideally, for greatest efficiency of operation, the number of times a hydraulic excavator or the tractor 12 is repositioned during a trenching operation should be kept to a minimum. One goal for an excavating operation is to move the machine, during the repositioning phase, the maximum distance that it can be moved and still effectively reach the end of the bottom of the trench already excavated, while minimizing the number of hops or repositioning phases needed to complete the continuous trench. Time devoted to machine repositioning is down time insofar as completing the trench is concerned because the machine is not digging when it is being repositioned.

Referring to FIG. 4, the trench already excavated (to the right in FIG. 4) includes an end 75 and a point 77 where the end 75 intersects the completed bottom 79 of trench 74. Taking as an example that the illustrated backhoe loader 10 can effectively excavate up to end 75 and point 77 from position $P_1$, backhoe loader 10 should be able to effectively reach the bottom 79 of trench 74 at point 77 with excavating assemblage 34 and continue the creation of a smooth trench bottom for a newly excavated trench section when repositioned to position $P_2$. Repositioning of a hydraulic excavator or the tractor 12 should be consistently for the same hop distance at each repositioning phase when the trenching depth remains constant, and that distance should be as close as possible to the working reach d. Of course, should the design depth of the trench 74 or other site conditions change as the excavating operation progresses, the working reach d could vary from one set-up position to another.

A "hop" distance d, or repositioning distance d, may be recommended to an operator performing a trenching operation with a backhoe loader or a hydraulic excavator. Ordinarily, an operator may use discretion and estimate a proper repositioning distance. It will be apparent that such an estimation may vary from one hop to another, as well as with the skill and experience of the operator. The recommended hop distance may be the greatest distance the machine can move forward, while still permitting the digging bucket to reach the bottom of the trench that has already been dug, and cleanly continue to dig the bottom of the trench and otherwise complete the trench to design specifications.

The maximum distance that a backhoe loader or a hydraulic excavator may move during a hop or repositioning phase may be based upon a variety of factors. For example, factors such as the geometry of the machine, including the effective lengths of the fully extended boom, stick, and bucket, affect a machine's working reach and, thus, the maximum distance for repositioning. The manner in which the bucket must dig into the soil (i.e., the required angle of the bucket relative to the stick and the trench bottom in order to be able to dig the bottom of the trench), the type of soil encountered, and the design depth of the trench all affect the maximum distance for machine repositioning between excavating phases.

Any of the factors of machine geometry, type of bucket employed, type of soil expected, etc., may be pre-programmed into the machine's control module, or in some cases sensed by the machine. For example, the machine may include an appropriate sensor to sense what type of bucket is currently attached using conventional radio frequency identification (RFID) technology. Alternatively, the operator may make a manual selection for entry of appropriate factor data into the control module via, for example, a suitable input device such as input/display device 54. The depth of the trench may be calculated using data from conventional sensors such as, for example, angle sensors or hydraulic cylinder position sensors.

Another way to sense trench depth may include keeping track of where the operator has been digging by, for example, having a virtual map in the memory of the control module to show what has been dug, and to provide indication of the vertical position of the trench floor based on a current location. Alternatively, a digging plan may be loaded into the memory of the control module to give an indication of the trench depth at a given, known machine location. As another alternative, the depth may simply be manually entered into the control module by the operator. When the various factors affecting the maximum machine repositioning distance are known, the machine may use them to calculate the maximum distance to be moved by, for example, employing a suitable equation or accessing a look-up table.

In an exemplary embodiment of the disclosure, a control module, such as an ECM, may be programmed to calculate and recommend an efficient permissible distance that a hydraulic excavator or a backhoe loader may be moved during a repositioning phase. An efficient permissible distance may be defined as a hop distance or repositioning distance that, under the circumstances, is the greatest distance that a machine may move during a repositioning phase and maintain greatest or optimum efficiency in a trenching operation. The efficient permissible distance may be the maximum permissible distance or an optimum permissible distance under the given circumstances of machine geometry, type of material being excavated, etc. For example, control module 52 may be programmed to calculate and recommend an efficient permissible distance for tractor 12 to move during a repositioning phase. The program for calculating and recommending the efficient permissible distance may be initiated by a machine operator. For example, the machine operator may conveniently activate a suitable virtual button on input/display device 54 while seated in seat 78 and positioned facing toward the machine rear 30 and excavating assemblage 34.

Figure 5:
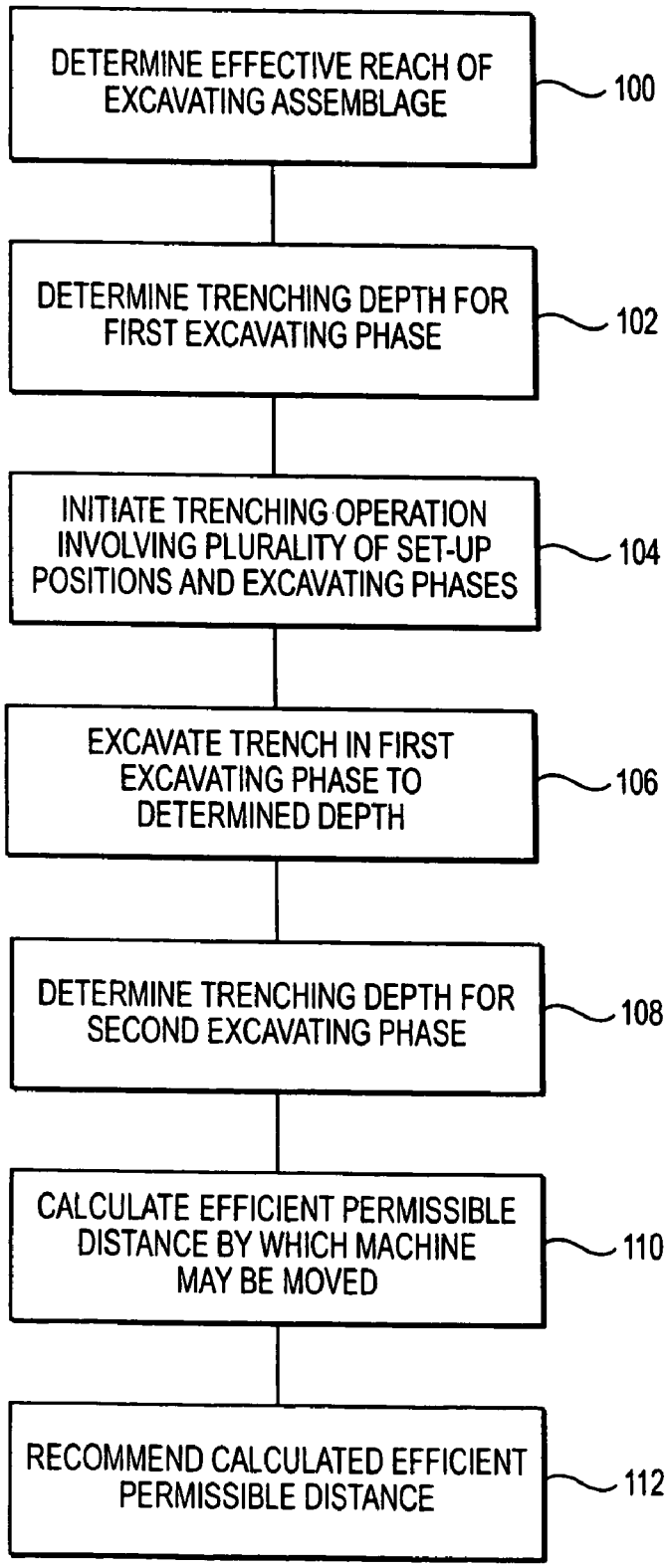
FIG. 5 is a flow chart according to an exemplary disclosed embodiment.

FIG. 5 diagrammatically illustrates, in flow chart form, one possible process for automating the recommendation of a repositioning distance. While certain actions of the process are indicated in FIG. 5, as well as indicated in a particular sequence for purposes of explanation, it should be understood that this is exemplary, and that the sequence of actions may be other than that illustrated in FIG. 5. In addition, the actions that occur also may vary from the exemplary embodiment of FIG. 5.

Referring to FIG. 5, at step 100 the effective reach of the excavating assemblage being employed for excavating a trench 74 is determined. This effective reach is determined based on a number of factors, at least some of which may be site specific. For example, the actual combined reach of the boom, stick, and bucket, when extended by their respective actuators, may be determined by the known dimensions and geometry of these elements. The presence or absence of an extendable stick (e-stick) is another factor that must be considered. Site specific factors include the size and type of bucket employed, and the type and consistency of the material being excavated. For example, in sand or loose soil, machine power and component strength may be sufficient to effectively excavate to the fully extended position of the boom, stick, and bucket. On the other hand, where very rocky ground, hard shale ground, or frozen ground is encountered, it may not be feasible to excavate at the fully extended position of the boom, stick, and bucket. Based on these various factors, for example, the effective reach may be determined. Information on all the foregoing factors may be entered into the control module via a suitable input device such as, for example, input/display device 54.

At step 102, the trenching depth for a first excavating phase is determined. This, for example, may be based simply on the design depth which may have been dictated by the proposed end use of the trench. Once the effective reach is determined at step 100 and the trenching depth is determined at step 102, the working reach d (FIGS. 3 and 4) becomes known. Conveniently, in order to establish a frame of reference, the trenching depth may be determined relative to a fixed point on the machine when the machine is in a set-up position and leveled. At step 104, a trenching operation is initiated, involving for its completion a plurality of set-up positions and a plurality of excavating phases. At step 106, the excavating assemblage is employed during a first excavating phase to excavate a trench to the depth determined for the first excavating phase and with a working reach d.

The trenching depth for a second excavating phase to immediately succeed the first excavating phase is determined at step 108. At step 110, an efficient permissible distance is calculated by which the machine may be moved while permitting trench excavation by the excavating assemblage during the second excavating phase to the depth determined for the second excavating phase and with a smooth, well-formed trench bottom. At step 112, based on the calculated result, an efficient permissible distance is recommended.

The recommended efficient permissible distance may be, for example, the maximum permissible distance the machine may be moved while permitting trench excavation by the excavating assemblage, the optimum permissible distance the machine may be moved while permitting trench excavation by the excavating assemblage, or some other distance that, given the surrounding circumstances, enhances the efficiency of the trenching operation beyond that subject to the vagaries of operator judgment. The recommendation may, for example, be recommended to a machine operator via input/display device 54. Alternatively, the recommendation may be displayed on some other display device located proximate a machine control station, for example a display located in cab 18. The recommendation, in addition to or in lieu of being displayed, may include programming the control module 52 to move the machine the recommended distance.

It will be understood that the recommended efficient permissible distance is, in fact, a recommendation which may suitably be overridden by the operator in the situation where control module 52 is programmed with the recommended efficient permissible distance. In situations where the recommended efficient permissible distance is displayed to the operator, but control module 52 is not programmed to move the machine the recommended distance, the operator may, based on discretion, site conditions, or other factors, choose not to follow the recommendation.

Once an excavating phase has come to-an end and it becomes necessary to move the machine to a new set-up position in order to continue a trenching operation, a number of actions may be necessary to prepare the machine for repositioning. One exemplary embodiment of the disclosure in which the machine may be prepared for repositioning from a current set-up position to the next successive set-up position is diagrammatically illustrated in FIG. 6 in the form of a flow chart. While the actions are indicated in a particular sequence in FIG. 6, it should be understood that this is exemplary, and that the sequence of actions may be other than that illustrated in FIG. 6. In addition, one or more of the actions indicated may, in a given situation, be omitted. Additionally, the identified actions should not be construed as exclusive of other actions that may be included in given circumstances.

Figure 6:
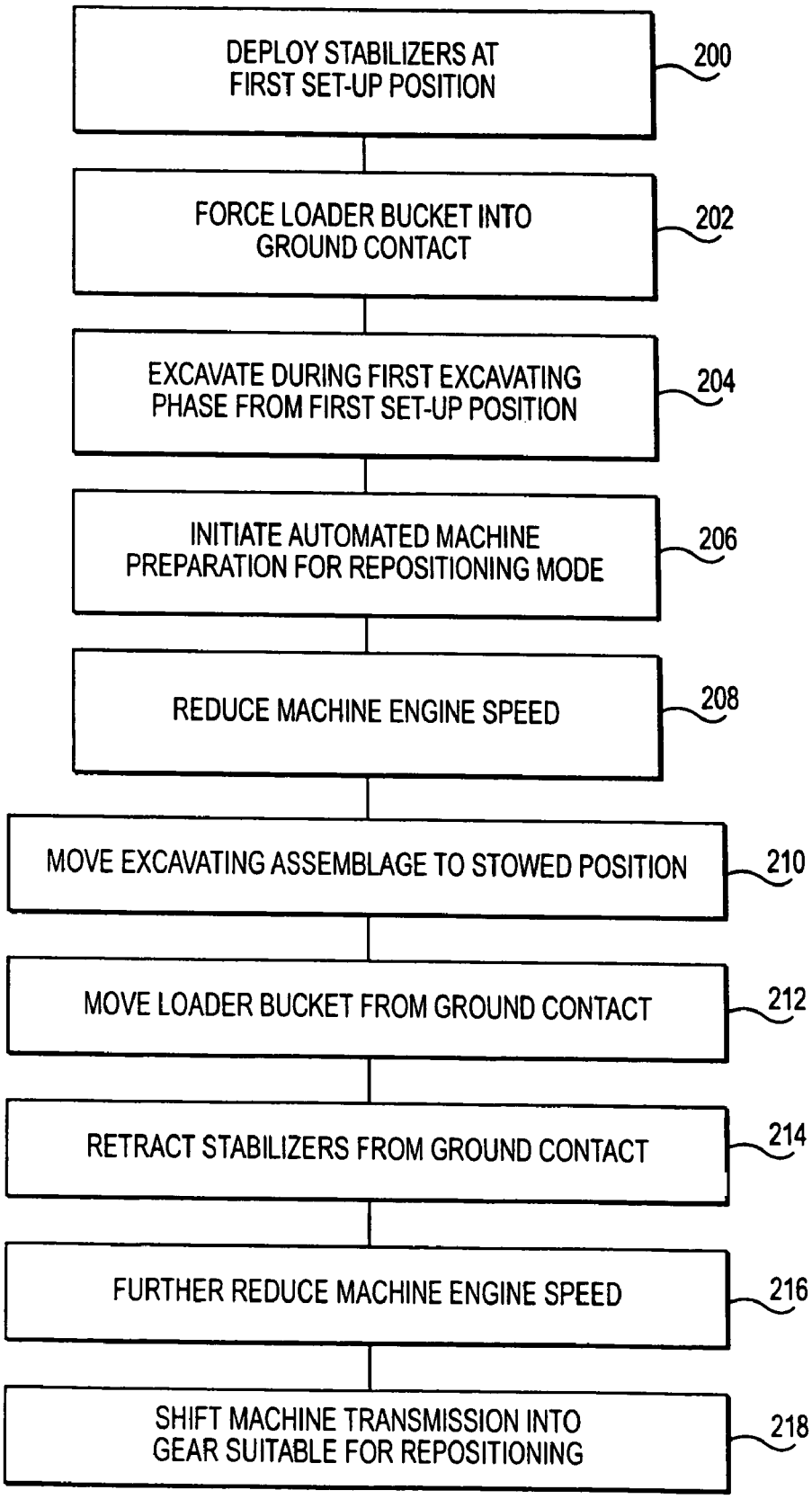
FIG. 6 is a flow chart according to another exemplary disclosed embodiment.

Referring to FIG. 6, the process may begin with the machine suitably located for initiating a trenching phase. At step 200, stabilizers 28 may be deployed to ground contact to stabilize the machine at a first set-up position. At step 202, loader bucket 21 may be forced into ground contact via operating linkage 24 and actuators 26 and 27. Together, the two stabilizers 28 and the loader bucket 21 may raise the machine such that the ground engaging wheels 14 and 16 are out of ground contact and the machine is suitably leveled (see FIG. 4). Once stabilized and leveled, excavating with the excavating assemblage 34 during a first excavating phase from the first set-up position may occur at step 204.

Once trenching at the first set-up position is completed, the operator may initiate, at step 206, an automated machine preparation for repositioning mode for preparing the machine, after the excavating phase, for repositioning to a second set-up position for a second excavating phase. This initiation may take place by activating an input device to send input signals to a controller, such as control module 52. For example, input/display device 54 may include a virtual button on a touch screen suitably configured to send, when activated, a signal to control module 52 to initiate the automated machine preparation for repositioning mode. Alternatively, initiating the automated machine preparation for repositioning mode may be accomplished with a toggle switch, a button, a control lever, or any other suitable input device.

Once the automated mode has been initiated at step 206, a number of subsequent actions may occur. Since machine speed ordinarily is relatively high during an excavating phase in order to accommodate the loads inherent in the act of excavating, machine engine speed is reduced at step 208 to a level below the machine engine speed employed during excavating. At step 210, the excavating assemblage 34 is moved to a stowed position, at step 212, loader bucket 21 is moved from ground contact, and at step 214, stabilizers 28 are retracted from ground contact.

At step 216, machine engine speed is further reduced, and at step 218, the machine transmission is shifted into a gear suitable to facilitate machine repositioning. Reduction of machine engine speed at step 216 may include reduction of engine speed to idle speed responsive to output signals delivered from control module 52. Reduction to idle speed may aid the shifting of the transmission into a suitable gear for machine repositioning at step 218.

In another exemplary embodiment of the disclosure in which the machine may be in the process of repositioning from a current set-up position to the next successive set-up position, the operator may suitably control propulsion and steering of the tractor 12 by an input device otherwise employed to control the excavating assemblage 34. Generally, a backhoe loader is driven from one location to another by an operator seated facing the front of the machine, usually by manipulating a steering wheel, a brake pedal, an accelerator pedal, etc. During excavating with the rear mounted excavating assemblage 34, the operator generally is seated facing the rear of the machine. A common expedient by which the operator may face in a forward direction for driving the tractor forward (such as during moving from one location to another or during operation of the front loader assembly 20) is a rotating seat 78.

Employing the rotating seat expedient, an operator may rotate the seat 78 from the rear facing direction (illustrated in FIG. 1), used during excavating with excavating assemblage 34, to a front facing direction for forward movement of the tractor 12 during a repositioning phase. While in the rear facing direction, the operator may suitably control an input device or devices to operate the excavating assemblage 34, including the swing mechanism 36, the boom 38, the stick 40 (and e-stick if present), and the bucket 42. On the other hand, while in the front facing direction, the operator may suitably control machine steering by, for example, a steering wheel 72. In addition, the operator may suitably control propulsion (or engine speed) by, for example, a pedal 70.

Figure 7:
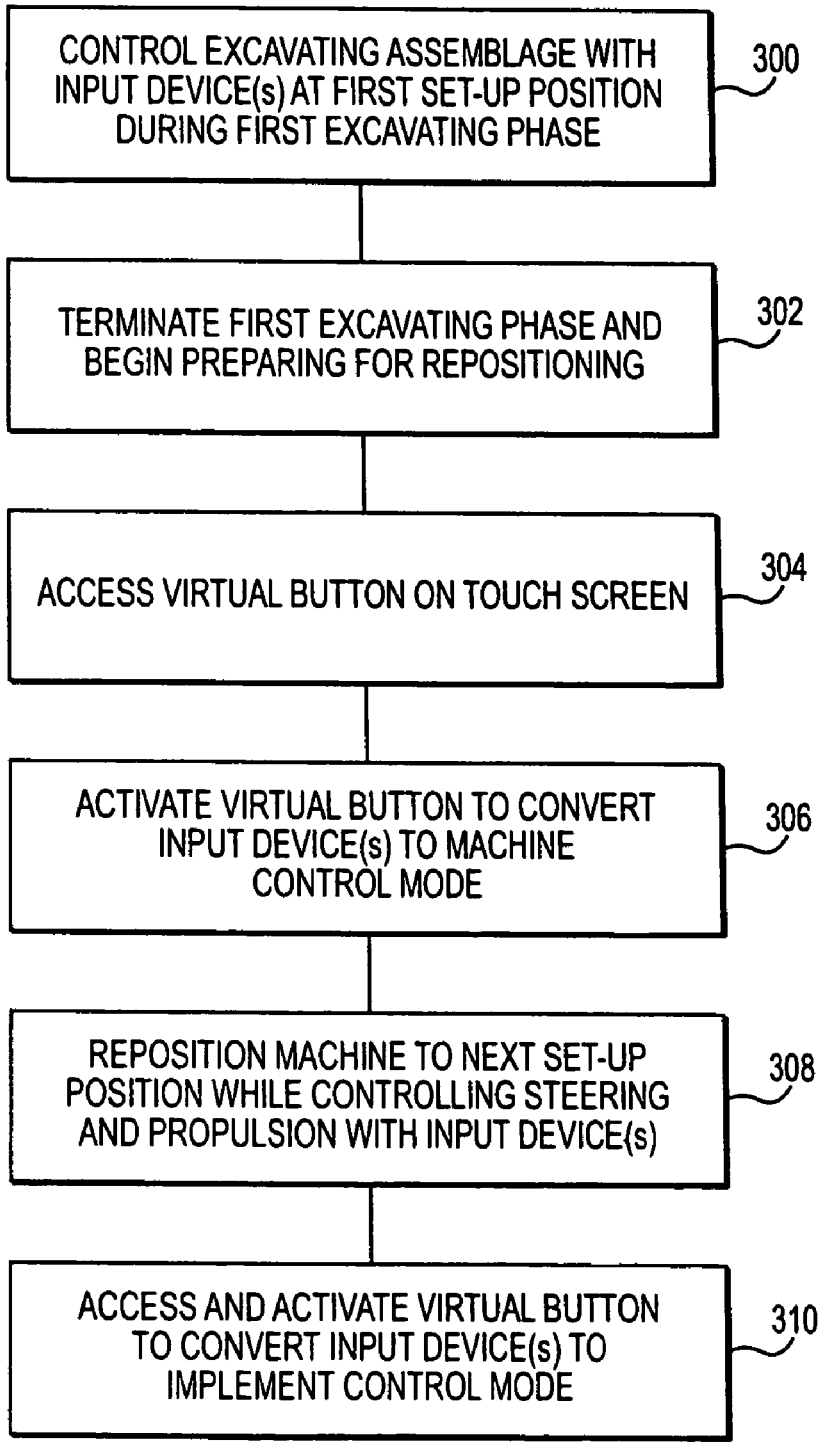
FIG. 7 is a flow chart according to another exemplary disclosed embodiment.

In FIG. 7, an exemplary disclosed embodiment for utilizing an input mechanism both for operating excavating assemblage 34 during an excavating phase, and for controlling steering and propulsion of tractor 12 during a repositioning phase, is diagrammatically illustrated in the form of a flow chart. Fully autonomous machine repositioning without operator intervention is difficult and expensive. However, with-appropriate automation, an operator may be permitted to exercise control expertly (even though the operator may not be an expert operator). In this exemplary embodiment, a balance between operator control and autonomous operation may be achieved. For example, the machine operator may intervene and interrupt automated control, or the operator may retain control over one or both of steering and propulsion.

Referring now to FIG. 7, at step 300, the operator may control the excavating assemblage 34 with an input device (or input devices), such as 56 (FIG. 2), at a first set-up position to excavate during a first excavating phase. Here, there may be, for example, right and left joysticks, such as right joystick 92 and left joystick 90 (FIG. 2) accessible to an operator's right and left hands, respectively, as the operator faces toward the rear of the machine. In one embodiment, the right joystick 92 may control two functions of the excavating assemblage 34 and the left joystick 90 may control two other functions of the excavating assemblage 34. For example only, the right joystick 92 may control swing mechanism 36 and stick 40, while the left joystick 90 may control boom 38 and bucket 42. Obviously, the combinations and permutations by which the joysticks 90, 92 may be programmed may vary.

At step 302, the operator may have terminated the first excavating phase and initiated automated preparation for repositioning to the next set-up position for continued excavating. Here, the machine may be at some point in the-process illustrated in FIG. 6 in preparation for repositioning. At this point, the operator may access a virtual button located on a touch screen display, at step 304, which may be a virtual button on the input/display device 54 illustrated in FIG. 2. At step 306, the operator may activate the virtual button to convert the input device (or input devices) to machine control mode. Where right and left joysticks comprise the input devices, one joystick may control propulsion and the other joystick may control steering. Alternatively, a single joystick may be converted such that, for example, forward and backward movement of the joystick controls propulsion (or engine speed) and side to side movement controls steering.

At step 308, the machine is repositioned to the next set-up position while the operator controls steering and propulsion via the input device or devices. Here, the operator may retain control of those functions over which the operator needs to maintain control. For example, the operator may retain control of a "go forward" command so that the machine does not move unless the operator initiates the command. To enable the operator to expertly stop the machine after it has moved a recommended distance to begin a new excavating phase, the controller may assist an operator initiated "stop" command. Thus, autonomous control and operator control act in synergy. The operator may remain facing toward the rear of the machine without the necessity of gaining access to the steering wheel 72 and pedal 70. Once the second set-up position is reached, the operator, at step 310, may access a virtual button to convert the input device or devices back to implement control mode for controlling the excavating assemblage 34.

Control module 52 may include a processor and memory as known in the art. The memory may store one or more routines, which could be software programs, for controlling the excavating assemblage 34 as well as other machine components. For example, the memory may store routines for controlling the machine during automated preparation for repositioning mode. Control module 52 may be configured to receive information from various input devices and from various sensors that may be associated with the excavating assemblage 34 or other machine components. For example, in connection with operation of excavating assemblage 34, various angle sensors or cylinder position sensors (not shown) may be included for determining the position of various cooperating components and enabling calculation of trench depth.

INDUSTRIAL APPLICABILITY

Figure 8:
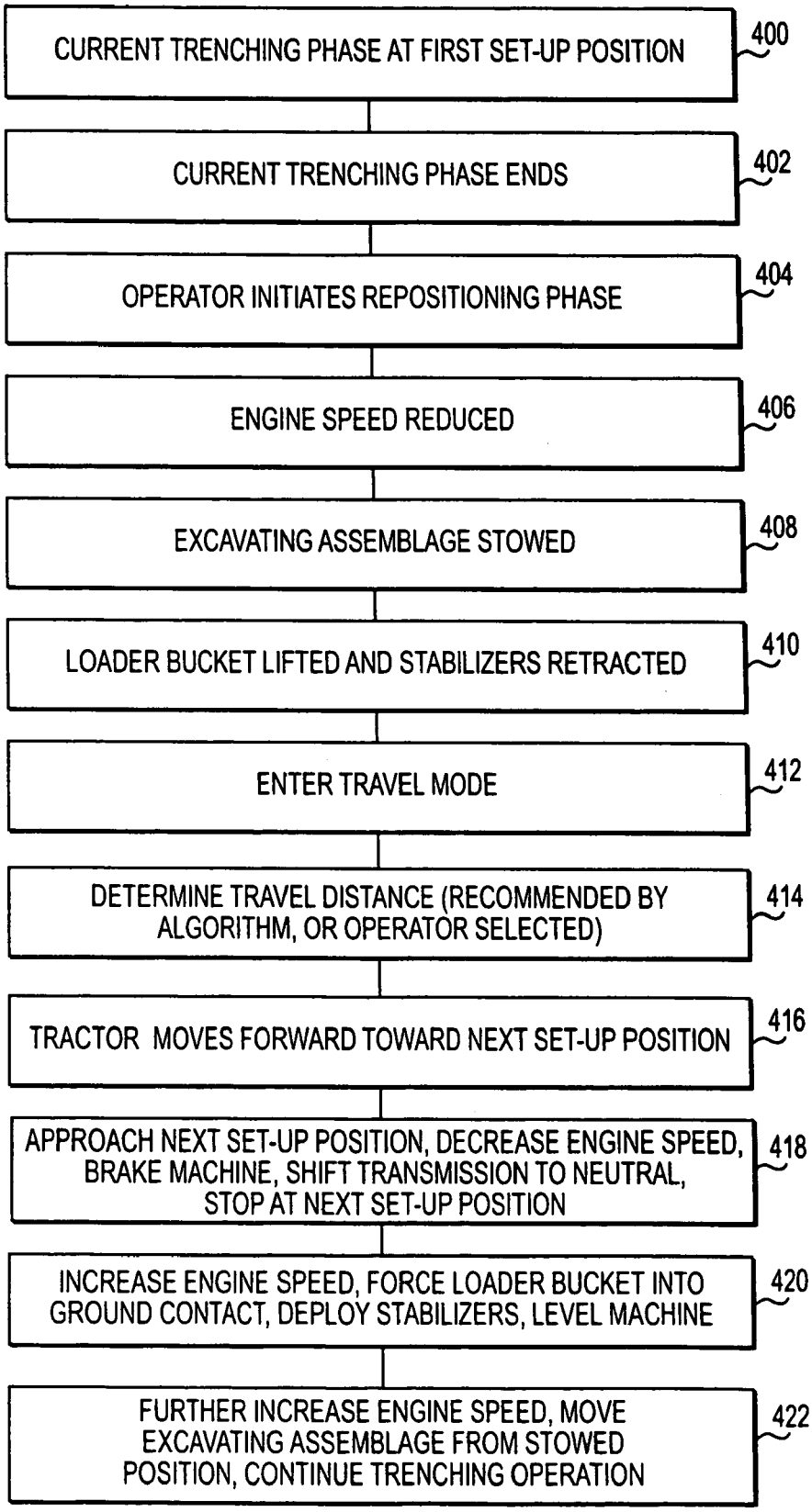
FIG. 8 is a flow chart according to another exemplary disclosed embodiment.

FIG. 8 discloses a fully automated process according to an exemplary disclosed embodiment. Upon start of the process at step 400, the operator may be in a current trenching phase at a first set-up position. During the trenching phase, the machine may be controlled to excavate a proposed trench with, for example, a backhoe loader 10. Since the proposed trench will be presumed to have a design length substantially greater than the extent to which the excavating assemblage 34 of the backhoe loader 10 can excavate from a single set-up position, it will be necessary to reposition the tractor 12, perhaps multiple times, in order to complete a continuous excavation to the design length. Accordingly, as the operator completes the current trenching phase by excavating to the design depth (which may vary according to the intended use of the trench) and as close to the tractor as is reasonable, the current trenching phase may come to an end at step 402. Then, the operator may be ready to move the tractor forward to a new set-up position in order to begin the next trenching phase.

At step 404, the operator initiates a repositioning phase. The repositioning phase may be initiated by moving a physical switch or lever, for example. Alternatively, the repositioning phase may be initiated by appropriately activating a virtual button on a touch screen display, such as input/display device 54 (FIG. 2). It will be recognized by those having skill in the art that these are merely examples of activating expedients, and that any other known expedient for initiating a programmed operation may be employed. Once the repositioning phase is initiated, a series of events may then take place to reposition the tractor 12 to a new set-up position.

At step 406, the engine speed may be reduced. Engine speed during an excavating phase may be relatively high in order to support the hydraulic system and the various hydraulic components that drive the excavating assemblage 34, for example. However, engine speed need not be. nearly so high for non-excavating functions, such as those that take place during a repositioning phase. Engine speed may be reduced as, or just before, the excavating assemblage 34 is moved to stowed position preparatory to repositioning. Alternatively, or additionally, engine speed may be reduced after the excavating assemblage 34 is moved to stowed position and as the loader bucket 21 is lifted and/or the stabilizers 28 are retracted.

At step 408, the excavating assemblage 34 may be moved to a stowed position out of the trench 74 and clear of ground contact. In this position, bucket 42 may be curled relative to stick 40, the stick 40 and bucket 42 may be pivoted into close proximity to the boom 38, and the entire assemblage may be centered relative to the tractor 12 by the swing assembly 36.

At step 410, the loader bucket 21 may be lifted from ground contact and stabilizers 28 may be retracted from ground contact. Movement of loader bucket 21 and stabilizers 28 may take place sequentially, simultaneously, or partly sequentially and partly simultaneously. This lifting of the loader bucket and retracting of the stabilizers allow the ground transportation wheels 14, 16 (or other ground transportation expedients such as tracks) to then fully support the tractor 12 in preparation for movement to the next set-up position.

Once the excavating assemblage 34 is stowed, the loader bucket 21 is lifted, and the stabilizers 28 are retracted, ground supporting wheels 14, 16 contact the ground and tractor 12 enters travel mode at step 412. Travel mode is entered by reducing engine speed further down to, for example, a low idle, allowing the transmission 61 to be smoothly placed in gear. After a slight delay encountered while the transmission 61 moves into an appropriate gear, engine 60 speed may increase somewhat in order to move the tractor 12 forward.

Up until this point, the series of activities from the time the repositioning phase is initiated until just before the tractor 12 begins to move forward may be designated as an automated preparation for repositioning mode (see FIG. 6, for example). During this automated preparation for repositioning mode, it will be understood that, from the time the repositioning phase is initiated at step 404, the activities including stowing the excavating assemblage 34, removing the loader bucket 21 from ground contact, retracting the stabilizers 28, reducing engine speed, and engaging a transmission gear appropriate for repositioning may all occur automatically, without manual intervention by the machine operator.

At some point, the travel distance during a machine repositioning phase may be determined. This determination may occur at any number of points in time. For example, as illustrated in FIG. 8, this determination may occur at some time after entry into travel mode. As indicated at step 414 in FIG. 8, travel distance may be determined, and this determination may either be by way of a recommendation by a suitable algorithm (see the discussion relevant to the embodiment illustrated in FIG. 5), or by operator selection.

At step 416, the tractor 12 may move from the current set-up position toward the next set-up position. The control system 50 may be programmed for semi-automation. The operator may manipulate one or more joysticks, or one or more suitable pedals, to command forward movement of the machine. During this movement, either or both of the steering and propulsion of the tractor 12 may be controlled by the operator through, for example, right joystick 92 and/or left joystick 90. Steering and propulsion of the tractor 12 via joystick control may be by one or more joysticks that may be converted from implement control mode to machine movement control mode in accordance with the discussion of the embodiment illustrated in FIG. 7. In this way, an operator need not change positions, such as by rotating seat 78, for example, and may use the same joystick or joysticks that are used to control the excavating assemblage by converting to steering and propulsion control mode. Control of steering and/or propulsion may thus remain with the operator. The operator may then suitably intervene to avoid any site obstructions or otherwise address safety concerns. Additionally, the operator maintains the sense of being in control, even though some functions are automated.

At step 418, tractor 12 approaches a programmed or desired distance for a new set-up location. As the distance moved approaches the desired repositioning or hop distance (such as, a recommended distance) that has been set, the machine may slow down regardless of operator input. This semi-automatic control gives the operator the control that may be needed while ensuring that the target distance is accurately achieved. If the operator, inadvertently or otherwise, attempts to exceed the target distance, the operator's input is overridden. Thus the machine stops at the target distance. This strict control of the repositioning or hop distance permits maximizing the distance between excavating phases, while still ensuring a smooth trench bottom and minimizing the time and effort that must be expended on the excavating operation.

As the machine approaches the new set-up location, the engine speed again may decrease to a low idle, machine brakes may engage, and the transmission may shift to neutral as the machine slows down and comes to a smooth stop. Control module 52 may determine when the machine has traveled the target distance to the new set-up position. Any suitable distance determining expedient, such as a GPS tracking system or an inertial tracking system, for example, may be employed to determine, how far the machine has moved. The tractor 12 may come to a smooth stop at the designated new set-up location, such as at a recommended efficient permissible distance from the first set-up position as determined in accordance with the procedure described in connection with FIG. 5. Once tractor 12 has come to a stop, transition from repositioning phase to excavating phase may begin.

At step 420, the engine speed may be increased to support lowering of the loader bucket 21 and stabilizers 28. The loader bucket 21 may be forced into ground contact and the stabilizers 28 may be deployed, all with sufficient force to raise and level the machine into a position supported by the loader bucket 21 and the stabilizers 28. In this position, the ground transportation wheels 14, 16 may be entirely out of contact with the ground (see FIG. 4).

At step 422, the engine 60 may increase speed to the level that supports an excavating phase. The excavating assemblage 34 may be moved from the stowed position to a position ready to resume trenching. Trenching may then be continued from the new set-up position within the working limits of the excavating assemblage or until the trench is finished.

It will be understood that the process schematically illustrated in FIG. 8 and described above is an exemplary embodiment which may vary. For example one or more actions identified in connection with FIG. 8 may be omitted in a given situation. Furthermore, it may be desirable in a given situation to include other actions not identified in connection with FIG. 8. In addition, the semi-automatic mode of operation may be applicable in situations where machine functions, such as steering and propulsion, are performed by input devices other than joysticks. For example, the control system may be configured such that the operator may initiate forward movement with a pedal, such as pedal 70 in FIG. 1, and the controller may stop the machine forward movement at a desired or pre-programmed position. This semi-automatic control may be used either during a hop or repositioning phase or during other forward machine movement. In addition, such semi-automatic control, wherein the operator initiates movement and a machine controller stops movement, is applicable to machines other than backhoe loaders, such as, for example, a hydraulic excavator.

Delays and inefficiencies are an ordinary part of an excavating operation requiring a plurality of set-up positions for its completion. By utilizing various expedients, including automation, such delays and inefficiencies may be avoided. For example, an efficient, permissible distance for machine repositioning between excavating phases in a trenching operation may be calculated and recommended under complete automation in order to enhance efficiency. As another example, certain preparation activities that occur upon termination of an excavating phase and prior to machine repositioning may be automated. As a further example, during machine repositioning, an implement control input device or input devices may be suitably converted to a mode for controlling machine steering and propulsion in order, among other things, to obviate the need for repositioning the operator seat.

The repositioning distance a machine must move from one set-up position to the next over the course of an extended trench excavating operation ordinarily is left to operator judgment and discretion. Because an efficient permissible distance for repositioning may be calculated and recommended to the operator based on numerous measured variables, reliance for best, maximum, and/or optimum distance to move between one set-up position and the next need not be left to operator discretion based on estimations. Since a consistent and efficient distance may be immediately available to the operator and actually programmed into the machine, the trench may be more efficiently excavated and, particularly with a trench of significant length, substantial time may be saved.

The actions which ordinarily take place in preparation for repositioning between set-up positions may be individually initiated by the machine operator. Aside from being one more fatigue factor, the efficiency and consistency of this series of actions may vary considerably, depending on the skill and experience of the operator. By automating the preparation for repositioning procedure, operator fatigue is reduced and efficiency and consistency of overall machine operation is enhanced. A novice operator may be able to operator a machine with the efficiency of an expert.

Because the machine operator may conveniently access an on-board touch screen display and activate a virtual button to convert an input device or devices from excavating assemblage control to steering and propulsion control, and vice versa, the operator need not move back and forth between the controls for the excavating assemblage (at the machine rear) and the controls for steering and propulsion (at the machine front). The touch screen display and instant conversion from one mode to another eliminates operator fatigue factors that are unavoidably a part of heavy equipment operation. Employing a touch screen for converting an input device or devices from one mode to another constitutes a safety feature since inadvertent conversion from one mode to another is more improbable than it would be where a switch or button, closely associated with the input device (such as a joystick) is employed.

Numerous actions are involved in the overall repositioning process between set-up positions in an excavating operation. Because the overall process may be automated, a significant reduction in operator fatigue and allowance for variance in operator skill and experience are realized. By retaining the option for operator intervention to control certain aspects of the repositioning process, such as machine speed, the desirable involvement in the process by the machine operator is retained for safety and error correction.

While the disclosed system and method have been described and illustrated in connection with a typical backhoe loader, it should be understood that other types of excavating assemblages, such as a hydraulic excavator, for example, may benefit from employing the disclosed system and method.

It will be apparent to those skilled in the art that various modifications and variations can be made to the disclosed system and method without departing from the scope of the disclosure. Other embodiments will be apparent to those skilled in the art from consideration of the specification and practice of the disclosed embodiments. It is intended that the specification and examples be considered as exemplary only with the true scope of protection being indicated by the following claims.

We claim:

1. A system for excavating a trench requiring a plurality of excavating phases, each from a different machine set-up position, comprising:

an excavating assemblage; and a control system configured to calculate repositioning distance for machine movement between excavating phases and set-up positions based upon an effective reach of the excavating assemblage and a trench depth, and configured to communicate the repositioning distance to a machine operator.

2. The system of claim 1, wherein the excavating assemblage includes a backhoe mechanism including a swing assembly, a boom, a stick, and a bucket, and wherein the control system is configured to factor in the type of bucket employed, or the type of material being excavated in calculating the repositioning distance.

3. The system of claim 2, wherein the stick is an extendable stick, and wherein the control system is configured to factor in additional reach facilitated by the extendable stick in calculating the repositioning distance.

4. The system of claim 1, wherein the controller is configured to determine the trench depth from a sensor associated with the excavating assemblage and a signal provided from the sensor during a first excavating phase.

5. A machine for excavating a continuous trench in a plurality of excavating phases, each excavating phase having a different machine set-up position along the oath of the trench being excavated, comprising:

an excavating assemblage including a boom pivoted to the machine, a stick pivoted to the boom, and a bucket pivoted to the stick; and a control module configured to calculate and recommend to an operator repositioning distance for machine movement between the excavating phases and set-up positions based upon a reach of the excavating assemblage and a desired trench depth.

6. The machine of claim 5, wherein the boom is pivoted to the rear of the machine, further including:

a front loader assembly mounted at the front of the machine;

a pair of stabilizers mounted on the machine;

an operator station on the machine and including a seat movable to a position facing toward the machine front and movable to a position facing toward the machine rear; and an input device positioned proximate the operator station.

7. The machine of claim 5, wherein the control module is further configured to include the type of material being excavated, or dimensions of the bucket being employed in calculating the recommended repositioning distance.

8. The machine of claim 5, further comprising a touch screen display configured to enable an operator to initiate calculation of the repositioning distance, the control module further configured for receiving input signals from the touch screen display and for delivering output signals to the touch screen display, the control module further configured for delivering output signals to:

display the repositioning distance on the touch screen display; and program the machine for moving the repositioning distance.

9. The machine of claim 5, wherein the controller is configured to receive a signal indicative of the desired depth from a sensor associated with the excavating assemblage.

10. A method of operating an excavating machine in a trenching operation, comprising:

initiating a trenching operation including a plurality of excavating phases for completion of a continuous trench, each excavating phase defined by a separate set-up position;

employing the excavating assemblage during a first excavating phase at a first set-up position to excavate a trench to a first desired depth;

activating an electronic controller for calculating a repositioning distance that the machine may be moved for a second excavating phase at a second set-up position based upon a second desired depth for the second excavating phase and a reach of the excavating assemblage; and providing a signal from the electronic controller communicating to an operator the calculated repositioning distance.

11. The method of claim 10, wherein communicating to the operator the calculated repositioning distance includes displaying the repositioning distance on a display device located proximate a machine control station.

12. The method of claim 10, further including, terminating the first excavating phase, and before moving the machine for the second excavating phase, initiating an automated machine preparation for repositioning mode for preparing the machine for repositioning for the second excavating phase.

13. The method of claim 10, further including:

initiating a machine repositioning phase by communicating a signal to the electronic controller; and autonomously moving the machine toward the second set-up position for the second excavating phase, the electronic controller;

determining when the machine has moved the calculated repositioning distance and reached the second set-up position for the second excavating phase; and stopping the machine under automated machine control at the second set-up position for the second excavating phase.

14. The method of claim 10, wherein the first and second desired depths are determined relative to a fixed point on the machine when the machine is in one of the set-up positions and leveled.

15. The method of claim 10, wherein the excavating assemblage includes a backhoe mechanism including a swing assembly, a boom, an extendable stick, and a bucket, and wherein the reach of the excavating assemblage includes the additional reach permitted by the extendable stick.

16. The method of claim 15, wherein calculating the repositioning distance includes factoring in the type and size of the bucket and the type of material being excavated.

17. The method of claim 10, wherein calculating the repositioning distance includes calculating the maximum permissible distance the machine may be moved while still permitting excavation of the continuous trench by the excavating assemblage to the second desired depth.

18. The method of claim 10, wherein calculating repositioning distance includes calculating the optimum permissible distance the machine may be moved while still permitting excavation of the continuous trench by the excavating assemblage to the second desired depth.

19. The method of claim 10, further including providing a signal to the controller indicative of the first desired depth during the first excavating phase, the second desired depth being determined by the controller based on the first desired depth.

20. The method of claim 19, wherein the signal is provided by a sensor associated with the excavating assemblage.

* * * * *